US005823329A

United States Patent [19]

Roberts

[11] Patent Number: 5,823,329

[45] Date of Patent: Oct. 20, 1998

[54] INFANT FOOD DISH WITH MOTIVATION MEANS

[76] Inventor: Brian G. Roberts, 12 Robinwood Ave., Toronto, Ontario, Canada, M5P 1X7

[21] Appl. No.: 917,129

[22] Filed: Aug. 25, 1997

[51] Int. Cl.[6] ..... B65D 77/00; A63H 5/00

[52] U.S. Cl. ..... 206/216; 206/542; 206/573; 206/575; 446/227; 446/299; 446/301; 446/304

[58] Field of Search ..... 206/216, 542, 206/573, 217; 220/575; 340/540; 446/129, 130, 227, 299, 301, 304

[56] References Cited

U.S. PATENT DOCUMENTS 4,765,465 8/1988 Yamada et al. ..... 206/217

5,254,007 10/1993 Eagan ..... 446/227

5,294,172 3/1994 Dubus ..... 446/227

5,607,077 3/1997 Torkelson ..... 206/542

*Primary Examiner*—M. D. Patterson

*Assistant Examiner*—Jila Mohandesi

*Attorney, Agent, or Firm*—Ridout & Maybee

[57] ABSTRACT

An infant's food dish includes a sound unit which is enabled by a switch, the state of which can be changed merely by bringing an object into proximity with the switch. Suitably the switch is magnetically operable and the object is the magnetized tip of a feeding utensil such as a spoon.

8 Claims, 2 Drawing Sheets

INFANT FOOD DISH WITH MOTIVATION MEANS

BACKGROUND OF INVENTION

This invention relates to apparatus for the motivation of infants when being weaned. Infants are born with an innate desire to suckle, and will ingest primarily milk from the mother's breast or bottle teat for the first several months of their lives. Many, if not most, infants are given pacifiers to satisfy their desire to suckle. Attempts to wean infants onto pureed solid foods to be eaten with a spoon are often met with resistance, perhaps due in part to the absence of suckling, and in part due to the different taste sensation being experienced.

Most infants are given toys which are often in the form of animal or humanoid characters, to certain of which the infant may bond with a remarkable affinity, as though the character were a living being. Parents have long appreciated the fact that an infant's behaviour can be motivated through role play with the toy character. It would not be uncommon to use a toy character as a prop when weaning an infant, wherein the parent might pretend to offer some food to the character for its approbation.

It is well known to provide infant's character toys with a sound unit. Commonly, such sound unit may include the capability of reproducing speech, wherein the speech is stored in analogue, or increasingly more commonly, in digital form, for replay upon enablement of the sound unit. Generally speaking, such enablement utilizes a microswitch incorporated into the toy; the switch may be of a self-latching type, so as to enable the sound unit for one or more cycles, or for a given period of time, or it may be of a momentary-on type. It is also known to provide a facility for recording sound including speech into the sound units in various types of apparatus for replay at subsequent times.

BRIEF SUMMARY OF INVENTION

This invention contemplates, in combination, an infant's food dish and an electronic sound unit, with latching means securing the sound unit to the food dish for support therefrom to permit the removal therefrom without the use of any tool. The combination further comprises a feeding utensil for use with the food dish, and a proximate switch means operable to enable the sound unit. The term proximate switch means as used throughout the specification and the claims annexed hereto includes any switch means that will change its state merely by bringing the feeding utensil into proximity therewith. Suitably, the proximate switch means will enable the sound unit for at least such time as the feeding utensil or a predetermined portion thereof is disposed in proximity to the proximate switch means. Preferably the proximate switch means comprises a magnetically operated reed switch and the feeding utensil includes a handle portion and a distal end portion with a tip, and the tip which is magnetized, but other forms of proximate switch means and means for their operation as are known in the art may be employed and substituted.

Also suitably, the feeding utensil is constructed from plastic material and is magnetized by means of a magnetic pellet embedded in the tip.

The sound unit may include a face plate portion and a body portion supported from the face plate portion, which body portion is disposed within a recess in the dish, wherein the face plate portion serves to cover and generally seal the recess to reduce the possibility of food entering within the recess and causing damage to the sound unit.

Suitably and preferably, the proximate switch means is disposed so as to be operable by the feeding utensil when the feeding utensil is disposed in proximity to the face plate. Most suitably, the face plate has a representation of a cartoon character applied thereto and the proximate switch means is disposed in the vicinity of the mouth of the cartoon character.

DESCRIPTION OF THE PREFERRED EMBODIMENT

Figure 1:
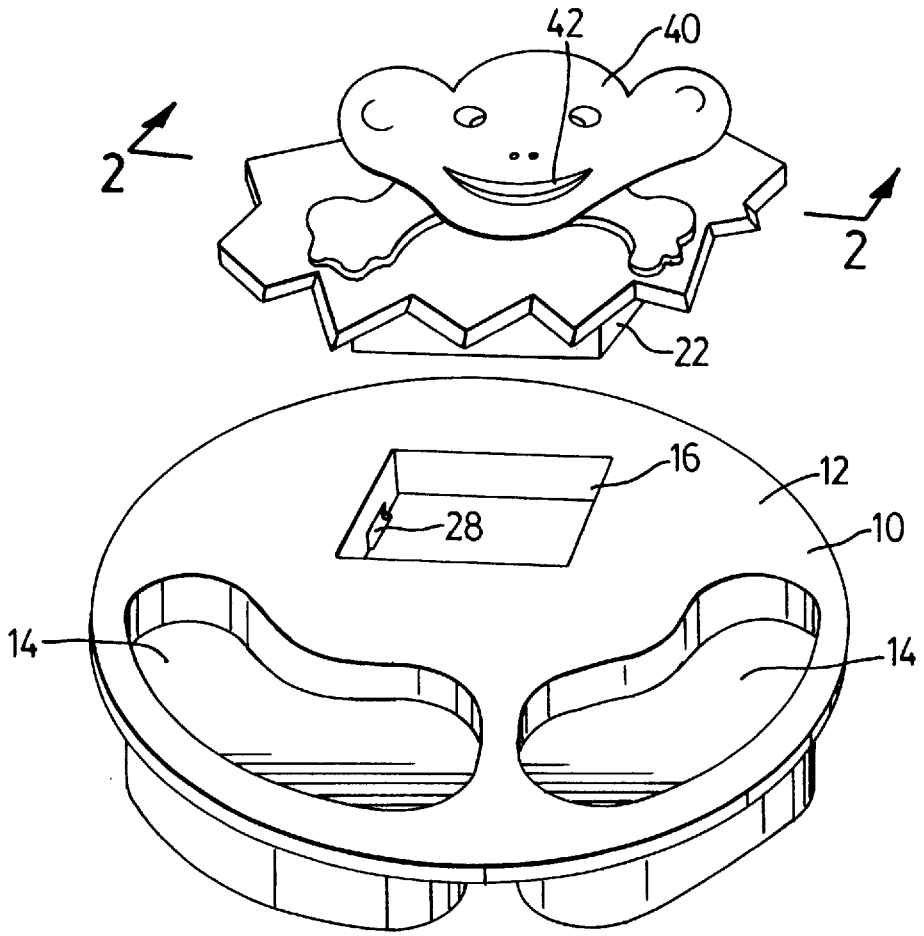
FIG. 1 shows in perspective, exploded form an infant's food dish and a sound unit.

Referring to the drawings in detail, an infant's food dish is generally denoted therein by the numeral 10. Dish 10 comprises a generally planar obverse face 12 having a pair of recesses 14 therein in which typically food for the infant will be placed. A third generally rectangular recess 16 is additionally provided in obverse face 12. A sound unit 20 comprises a generally box-like body portion 22 adapted to be received in rectangular recess 16 for support from dish 10. Body portion [22] includes a pair of resiliently sprung hook members 24. Batteries 26 are contained within sound unit [20] to provide power, the sound unit is adapted to latch onto openings 28 provided in recess 16.

A circuit board 30 is mounted within body portion 20 and includes components 32 forming a speech unit thereon. Sound unit 20 further comprises a face plate 40 which has a periphery somewhat greater than the periphery of box portion 22 whereby when the sound unit 20 is latched to dish 10, the face plate 40 generally seals to the obverse face 12 of dish 10 in portions thereof surrounding recess 16 to provide at least a gross seal to prevent the ingress of liquids into recess 16.

Face plate 40 carries thereon the form of a cartoon character, and includes a representation of a mouth 42. A small reed switch 44 is secured to the underside of face plate 40 by any convenient means such as by gluing in the vicinity of mouth 42. Flying leads 46 conveniently connect reed switch 44 to circuit board 30. Sound unit 20 further comprises a switch 48 which is accessible only upon withdrawal of the sound unit from recess 16 and which may be set to a position wherein sound may be recorded to sound unit 20 by means of a built-in microphone 50.

The combination further comprises a feeding utensil 60 moulded from a plastic utensil having a handle 62 and a spooned end 64 in the tip 66 of which is embedded a small magnetic pellet 68.

Figure 2:
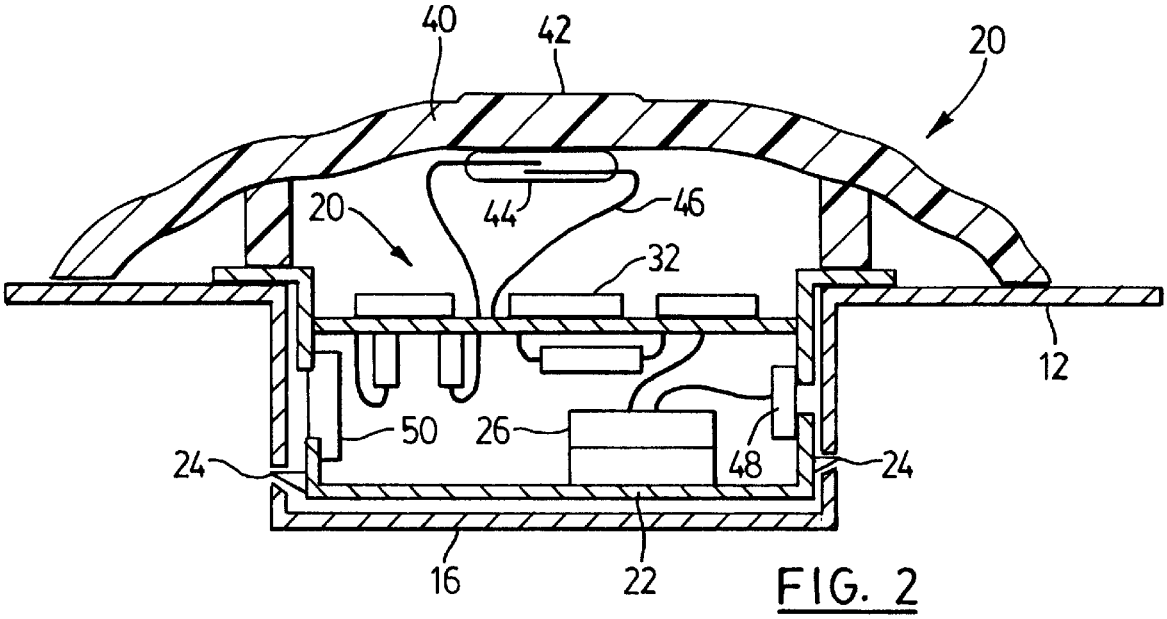
FIG. 2 is a cross-sectional view on line 2—2 of FIG. 1, showing the parts in their engaged relationship.
Figure 3:
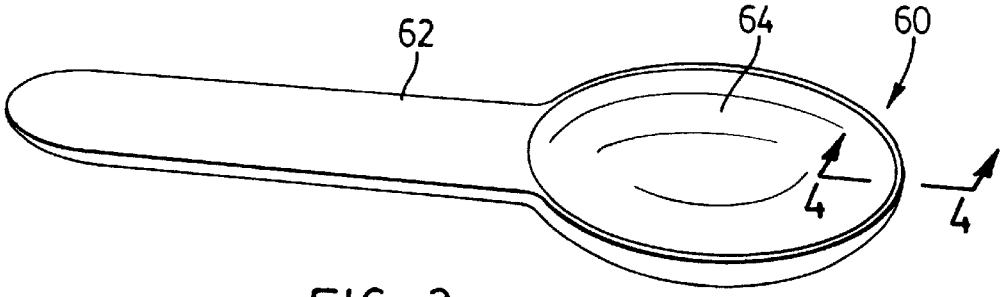
FIG. 3 shows in perspective view a feeding utensil for use with the infant's food dish of FIG. 1.
Figure 4:
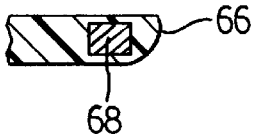
FIG. 4 shows a fragmentary cross-section on the line 4—4 of FIG. 3.

In operation, the sound unit 20 is latched to a dish 10 by hooked end [24] which will automatically snap engage in openings 28 in recess 16 as the sound unit is urged towards dish 10. As will be appreciated from FIG. 2, hooked end [24] will be disengagable from their latching engagement with openings 28 by manual pressure applied to the hooked ends, whereby the sound unit 20 may be disengaged from dish 10 when desired. Sound unit 20 is enabled by bringing the tip 66 of spooned portion 64 into proximity with the mouth of 42 of the face plate 40, and may typically be programmed to give a reinforcing, motivational message such as "I like my spinach".

I claim:

1. In combination: an infant's food dish;

an electronic sound unit;

latch means securing said sound unit to said food dish for support therefrom to permit the removal therefrom without the use of any tool;

a feeding utensil for use with said food dish; and a proximate switch means operable to enable said sound unit for at least such time as said feeding utensil is disposed in proximity to said proximate switch means.

2. The combination of claim 1 wherein said proximate switch means is a magnetically operable reed switch, and wherein said feeding utensil has a tip which is magnetized.

3. The combination of claim 2 wherein said feeding utensil is constructed from plastic material and is magnetized by means of a magnetic pellet embedded in said tip.

4. The combination of claim 3 wherein said feeding utensil is a spoon.

5. The combination of claim 1 wherein said sound unit includes a face plate portion and a body portion and wherein said body portion is disposed within a recess in said dish and wherein said face plate acts to cover and generally seal said recess.

6. The combination of claim 5 wherein said proximate switch means is disposed so as to be operable by said feeding utensil when said feeding utensil is disposed in proximity to a preselected portion of said face plate.

7. The combination of claim 6 wherein said face plate has the representation of a cartoon character applied thereto, and wherein the preselected portion is the mouth of the character.

8. The combination of claim 1 wherein said sound unit includes a microphone for use in recording a message to seal sound unit.

* * * * *